US006043606A

United States Patent [19]

Arts et al.

[11] Patent Number: 6,043,606

[45] Date of Patent: Mar. 28, 2000

[54] DISCHARGE LAMP DEVICE HAVING A PREHEATING ELECTRODE CIRCUIT

[75] Inventors: Paulus P. B. Arts, Oss; Wilhelmus H. M. Langeslag; Jurgen M. A. Willaert, both of Eindhoven, all of Netherlands

[73] Assignee: U.S. Philips Corporation, New York, N.Y.

[21] Appl. No.: 09/282,327

[22] Filed: Mar. 31, 1999

[30] Foreign Application Priority Data

Apr. 2, 1998 [EP] European Pat. Off. ..... 98201048

[51] Int. Cl.[7] ..... H05B 37/02

[52] U.S. Cl. ..... 315/94; 315/105; 315/209 R

[58] Field of Search ..... 315/209 R, 224, 315/225, 276, 94, 107, 105, 106, 291, 307, 308, 219, DIG. 5, DIG. 7

[56] References Cited

FOREIGN PATENT DOCUMENTS

WO9719578 5/1997 WIPO .

*Primary Examiner*—David H. Vu

*Attorney, Agent, or Firm*—Edward Blocker; Bernard Franzblau

[57] ABSTRACT

The invention relates to a circuit arrangement for operating a discharge lamp with a high frequency current comprising a power feedback circuit and a electrode preheater. The circuit arrangement comprises an antiboost switch for disabling the power feedback circuit before the lamp has ignited and enabling the power feedback circuit after the lamp has ignited- In accordance with the invention the antiboost switch is also used to enable the electrode preheater before the lamp has ignited and to disable the electrode preheater after the lamp has ignited.

17 Claims, 1 Drawing Sheet

DISCHARGE LAMP DEVICE HAVING A PREHEATING ELECTRODE CIRCUIT

BACKGROUND OF THE INVENTION

This invention relates to a circuit arrangement for operating a discharge lamp with a high frequency current comprising

- input terminals for connection to a source of low frequency supply voltage,
- rectifier means coupled to said input terminals for rectifying said low frequency supply voltage,
- a first circuit comprising a series arrangement of first unidirectional means, second unidirectional means and first capacitive means, said first circuit being coupled to a first output terminal N3 of said rectifier means and a second output terminal N5 of said rectifier means,
- inverter means coupled to said first capacitive means for generating the high frequency current,
- a load circuit comprising inductive means, second capacitive means and terminals for lamp connection, said load circuit being coupled to said inverter means,
- power feedback means connecting a terminal N6 of said load circuit to a
- terminal N7 between the first unidirectional means and the second unidirectional means,
- a second circuit comprising an antiboost switching element S and shunting at least one of the first and second unidirectional means, a control electrode of said switching element being coupled to a control circuit for rendering the switching element conductive and non-conductive, and
- a third circuit for heating the electrodes of the discharge lamp comprising a first and a second secondary winding, said first and second secondary windings during operation each being part of a series arrangement shunting a lamp electrode.

Such a circuit arrangement is known from WO 97/19578. The known circuit arrangement is very suitable to be powered from a regular mains supply generating, e.g. a supply voltage having an r.m.s. voltage of 230 Volt and a frequency of 50 Hz. Since the known circuit arrangement is equipped with power feedback means, it has a relatively high power factor that is realized with comparatively simple means. The circuit arrangement is so dimensioned that during stationary lamp operation there exists a balance between the amount of power fed back by the power feedback means and the amount of power consumed by the lamp. Before the lamp is ignited, however, the lamp does not consume any power which can lead to the power feedback means charging the first capacitive means to such a high voltage that part of the circuit arrangement, e.g. the inverter means, could be damaged. To prevent this, the circuit arrangement is equipped with the second circuit. In the known circuit arrangement the control circuit that is comprised in the second circuit monitors the voltage over the first capacitive means. If this voltage becomes higher than a first predetermined value, the control circuit renders the antiboost switching element S conductive, thereby disabling the power feedback means. After the lamp has ignited it starts to consume power so that the voltage across the first capacitive means drops below a second predetermined value, whereupon the control circuit renders the antiboost switching element S non-conductive thereby once more enabling the power feedback means. In the known circuit arrangement the secondary windings comprised in the third circuit are magnetically coupled to the inductive means comprised in the load circuit. Both secondary windings are arranged in series with a capacitor and the resulting series arrangements shunt respective electrodes of the lamp. Before the ignition of the lamp the inverter operates at a frequency at which the impedances of the capacitors comprised in the third circuit are relatively small. As a result a current with a relatively high amplitude flows through the lamp electrodes so that they are heated effectively. After ignition of the lamp the inverter operates at a much lower frequency so that the impedances of the capacitors are relatively high and the lamp electrodes carry a relatively small current. A disadvantage of the known circuit arrangement is that the current that flows through the lamp electrodes during stationary operation, though it is relatively small, continuously dissipates power in the electrodes thereby lowering the efficacy of the circuit arrangement.

SUMMARY OF THE INVENTION

The invention aims to provide a circuit arrangement for operating a discharge lamp that warms the electrodes of the discharge lamp effectively before lamp ignition and does not dissipate electrode heating power in the electrodes during stationary operation.

A circuit arrangement as described in the opening paragraph is therefore according to the invention characterized in that the second circuit comprises a series arrangement of third unidirectional means and the antiboost switching element S and in that a fourth circuit comprising a primary winding that is magnetically coupled with the first and second secondary winding is coupled between a common terminal of the switching element and the third unidirectional means and a terminal of the load circuit.

Before ignition of the lamp the control circuit renders the antiboost switching element S conductive. In a circuit arrangement according to the invention, this not only prevents an overvoltage over the first capacitive means by disabling the power feedback means, but also causes current to flow in the primary winding comprised in the fourth circuit. Since the primary winding is magnetically coupled to both secondary windings comprised in the third circuit, these secondary windings cause an electrode heating current to flow in both electrodes. When, after ignition of the lamp the control circuit renders the antiboost switching element S non-conductive, this does not only enable the power feedback means but also makes sure that the primary winding in the third circuit can no longer conduct current. As a result no electrode heating power is dissipated in the lamp electrodes after the ignition of the lamp, so that the circuit arrangement according to the invention has a relatively high efficacy during stationary operation. The relatively high efficacy of the circuit arrangement according to the invention is achieved using only relatively few additional components since the antiboost switching element S in a circuit arrangement according to the invention thus has two very different functions.

Preferably, the series arrangement comprised in the fourth circuit comprises third capacitive means. These third capacitive means prevent the flow of a DC current in the series arrangement.

Good results have been obtained for a circuit arrangement according to the invention, wherein said inverter means comprise a series arrangement of a first switching element, a terminal N1 and a second switching element, said terminal N1 being positioned between the first and second switching elements, and a drive circuit DC coupled to the switching elements for generating a drive signal for rendering the switching elements alternately conducting and non-conducting. Preferably the series arrangement of the first and second unidirectional means is shunted by a series arrangement of fourth and fifth unidirectional means and a common terminal N2 of the fourth and fifth unidirectional means is connected to terminal N1 by means of the load circuit. In this way the circuit arrangement incorporates an extra power feedback. Because of this extra power feedback the circuit arrangement causes relatively little harmonic distortion of the low frequency supply current, while the circuit arrangement is also capable of operating discharge lamps having a relatively high lamp voltage without the drawback of components comprised in the load circuit and the inverter having to conduct a relatively large current during lamp operation. It has been found that the functioning of the circuit arrangement improved where the circuit arrangement comprises a fifth circuit comprising fourth capacitive means for connecting terminal N2 to a terminal N4 between the first capacitive means and the fifth unidirectional means. This fifth circuit can comprise only the fourth capacitive means, but alternatively it is also possible that the fifth circuit comprises for instance a series arrangement of the first capacitive means and the fourth capacitive means.

In a preferred embodiment of a circuit arrangement according to the invention the circuit arrangement comprises a series arrangement comprising the antiboost switching element S and the primary winding, said series arrangement connecting terminal N1 to terminal N4.

The power feedback means preferably comprises capacitive means. In this way it is prevented that the power feedback means carry a DC current.

A satisfactory functioning of the circuit arrangement has been found where the control circuit comprises means for rendering the antiboost switching element S conductive and non-conductive dependent upon of the voltage across said first capacitive means.

BRIEF DESCRIPTION OF THE DRAWING

An embodiment of the invention will be explained in more detail with reference to a drawing, in which.

DETAILED DESCRIPTION OF THE PREFERRED EMBODIMENT

Figure 1:
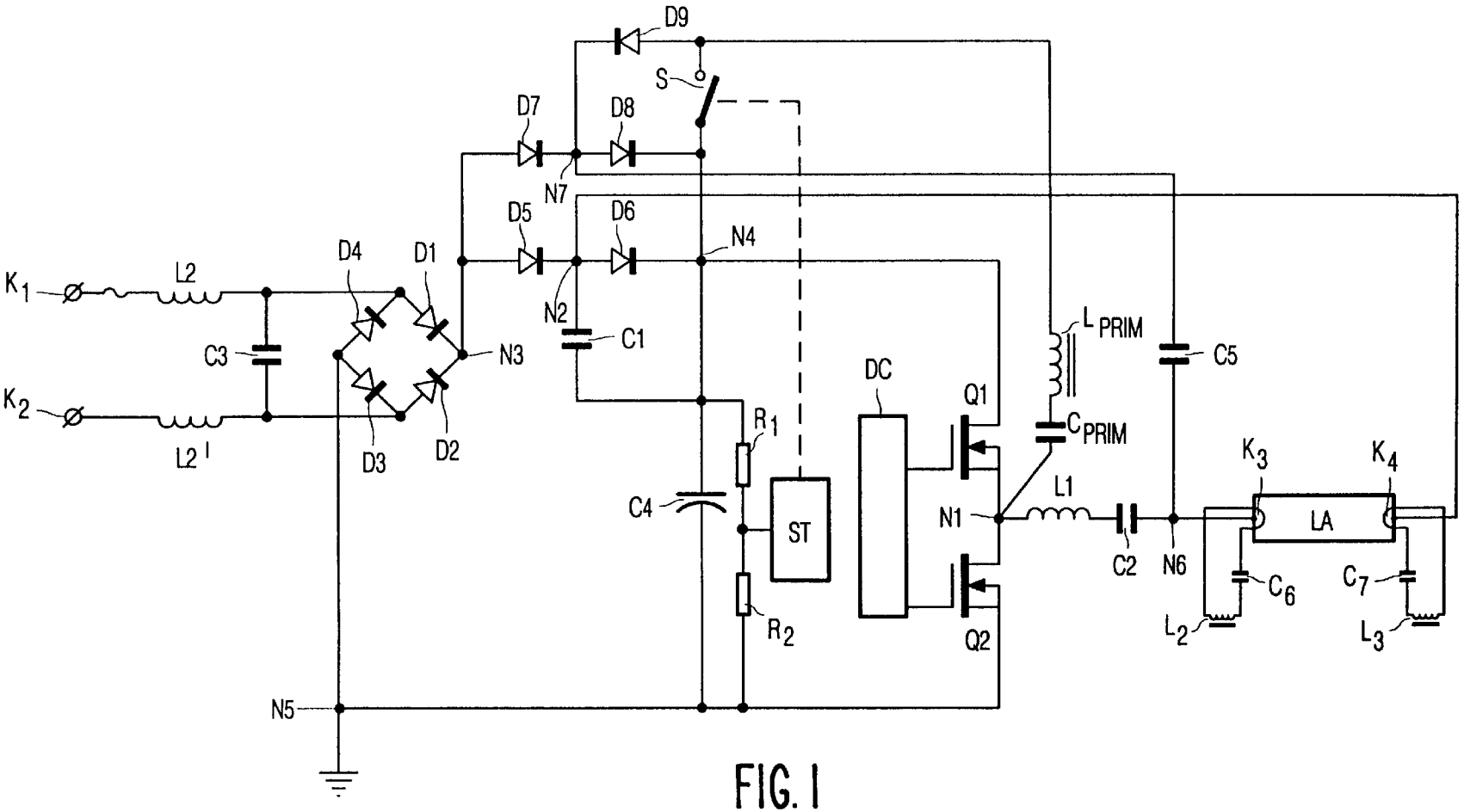
FIG. 1 is a simplified schematic diagram of an embodiment of a circuit arrangement according to the present invention with a discharge lamp LA connected to the circuit arrangement.

In FIG. 1 K1 and K2 are input terminals for connection to a source of low frequency supply voltage. L2 and L2' are inductors that form an input filter together with capacitor C3. Diodes D1–D4 are rectifier means for rectifying said low frequency supply voltage. In this embodiment diodes D7 and D8 form first and second unidirectional means respectively. Capacitor C4 is first capacitive means and forms together with diodes D7 and D8 a first circuit. Switching elements Q1 and Q2 together with drive circuit DC form inverter means. Drive circuit DC is a circuit part for generating drive signals for rendering switching elements Q1 and Q2 conducting and non-conducting. Inductor L1 capacitor C2 and terminals K3 and K4 for connection to a discharge lamp together form a load circuit. In the embodiment shown in FIG. 1 inductor L1 forms inductive means, capacitor C2 forms second capacitive means and terminals K3 and K4 form terminals for lamp connection. Capacitor C1 forms a fifth circuit and fourth capacitive means. Diodes D5 and D6 form fourth and fifth unidirectional means respectively. Capacitor C5 forms fifth capacitive means and also power feedback means. Diode D9 and antiboost switching element S together with resistors R1 and R2 and circuit part ST form the second circuit. Resistors R1 and R2 and circuit part ST together form a control circuit for rendering the antiboost switching element conductive and non-conductive. Diode D9 forms third unidirectional means. Primary winding Lprim together with capacitor Cprim forms a fourth circuit. Cprim forms third capacitive means. First secondary winding L2, second secondary winding L3 and capacitors C6 and C7 together form a third circuit for heating the electrodes of the discharge lamp.

Input terminals K1 and K2 are connected by means of a series arrangement of inductor L2, capacitor C3 and inductor L2' respectively. A first side of capacitor C3 is connected to a first input terminal of the rectifier bridge and a second side of capacitor C3 is connected to a second input terminal of the rectifier bridge. A first output terminal N3 of the rectifier bridge is connected to a second output terminal N5 of the rectifier bridge by means of a series arrangement of diode D5, diode D6 and capacitor C4. N2 is a common terminal of diode D5 and diode D6. N4 is a common terminal of diode D6 and capacitor C4. Terminal N2 is connected to terminal N4 by means of capacitor C1. The series arrangement of diodes D5 and D6 is shunted by a series arrangement of diodes D7 and D8. Diode D8 is shunted by a series arrangement of diode D9 and antiboost switching element S. N7 is a common terminal of diodes D7 and D8. Capacitor C4 is shunted by a series arrangement of switching elements Q1 and Q2. A control electrode of switching element Q1 is connected to a first output terminal of drive circuit DC. A control electrode of switching element Q2 is connected to a second output terminal of drive circuit DC. N1 is a common terminal of switching element Q1 and switching element Q2. Terminal N1 is connected to terminal N2 by means of a series arrangement of respectively inductor L1, capacitor C2, terminal K3, discharge lamp LA and terminal K4. N6 is a common terminal of capacitor C2 and terminal K3. Terminal N6 is connected to terminal N7 by means of capacitor C5. A first electrode of lamp LA is shunted by a series arrangement of first secondary winding L2 and capacitor C6. A second electrode of lamp LA is shunted by a series arrangement of second secondary winding L3 and capacitor C7. A common terminal of diode D9 and antiboost switching element S is connected to terminal N1 by means of a series arrangement of Lprim and Cprim. Capacitor C4 is shunted by a series arrangement of resistors R1 and R2. A common terminal of resistor R1 and resistor R2 is connected to an input terminal of circuit part ST. An output terminal of circuit part ST is coupled to a control electrode of antiboost switching element S. This latter coupling is shown in FIG. 1 by means of a dotted line.

The operation of the circuit arrangement shown in FIG. 1 is as follows.

When input terminals K1 and K2 are connected to the poles of a source of a low frequency supply voltage, the rectifier bridge rectifies the low frequency supply voltage supplied by this source so that a DC-voltage is present over capacitor C4 serving as a buffer capacitor. Drive circuit DC renders the switching elements Q1 and Q2 alternately conducting and non-conducting and as a result a substantially square wave voltage having an amplitude approximately equal to the amplitude of the DC-voltage over capacitor C4 is present at terminal N1. Power feedback is effected both via capacitor C5 and diodes D7 and D8, as well as via the load circuit and diodes D5 and D6. Before the lamp LA has ignited, it does not consume power so that at this stage of the lamp operation there is an unbalance between the power fed back and the amount of power consumed by the lamp. As a result the voltage over capacitor C4 increases to a value that is larger than a first predetermined level so that the control circuit renders the antiboost switching element S conductive. The power feedback that takes place via capacitor C5 and diodes D7 and D8 is thereby disabled and an overvoltage over capacitor C4 is prevented. The fact that the antiboost switching element S is conductive also causes an alternating current to flow through the series arrangement of primary winding Lprim and capacitor Cprim. Since the primary winding Lprim is magnetically coupled to secondary windings L2 and L3, this alternating current causes alternating voltages to be present across secondary windings L2 and L3, which alternating voltages in turn cause electrode heating currents to flow through the electrodes of the lamp LA. After the lamp has ignited and starts to consume power the voltage over capacitor C4 drops beneath a second predetermined value and the control circuit renders the antiboost switching element S non-conductive thereby enabling the power feedback by means of capacitor C5 and diodes D7 and D8. After the antiboost switching element S has become non-conductive the primary winding Lprim no longer carries a current so that the electrode heating current becomes zero.

We claim:

1. A circuit arrangement for operating a discharge lamp with a high frequency current comprising:

input terminals for connection to a source of low frequency supply voltage, rectifier means coupled to said input terminals for rectifying said low frequency supply voltage, a first circuit comprising a series arrangement of first unidirectional means, second unidirectional means and first capacitive means, said first circuit being coupled to a first output terminal (N3) of said rectifier means and a second output terminal (N5) of said rectifier means, inverter means coupled to said first capacitive means for generating the high frequency current, a load circuit comprising inductive means, second capacitive means and terminals for lamp connection, said load circuit being coupled to said inverter means, power feedback means connecting a terminal (N6) of said load circuit to a terminal (N7) between the first unidirectional means and the second unidirectional means, a second circuit comprising an antiboost switching element (S) and shunting at least one of the first and second unidirectional means, a control electrode of said switching element being coupled to a control circuit for rendering the switching element conductive and non-conductive, a third circuit for heating the electrodes of the discharge lamp comprising a first secondary winding and a second secondary winding, said first and second secondary windings during operation each being part of a series arrangement shunting a lamp electrode, characterized in that the second circuit comprises a series arrangement of third unidirectional means and the antiboost switching element (S) and in that a fourth circuit comprises a primary winding that is magnetically coupled with the first and second secondary winding and is coupled between a common terminal of the switching element and the third unidirectional means and a terminal of the load circuit.

2. The circuit arrangement according to claim 1, wherein said fourth circuit comprises third capacitive means in series with the primary winding.

3. The circuit arrangement according to claim 2, wherein said inverter means comprises series arrangement of a first switching element, a terminal (X1) and a second switching element, said terminal (N1) being positioned between the first and second switching elements, and a drive circuit (DC) coupled to the switching elements for generating a drive signal for rendering the switching elements alternately conducting and non-conducting.

4. The circuit arrangement according to claim 2, wherein said control circuit comprises means for rendering the switching element (S) conductive and non-conductive dependent upon the voltage across said first capacitive means.

5. The circuit arrangement according to claim 1, wherein said inverter means comprises a series arrangement of a first switching element, a terminal (N1) and a second switching element, said terminal (N1) being positioned between the first and second switching elements, and a drive circuit DC coupled to the switching elements for generating a drive signal for rendering the switching elements alternately conducting and nonconducting.

6. The circuit arrangement according to claim 5, wherein said control circuit comprises means for rendering the switching element (S) conductive and non-conductive dependent upon the voltage across said first capacitive means.

7. The circuit arrangement according to claim 5, wherein the series arrangement of the first and second unidirectional means is shunted by a series arrangement of fourth and fifth unidirectional means and a common terminal (N2) of the fourth and fifth unidirectional means is connected to terminal (N1) by means of the load circuit.

8. The circuit arrangement according to claim 7, which further comprises a series arrangement comprising the antiboost switching element (S) and the primary winding, said series arrangement connecting terminal (N1) to terminal (N4) between the first capacitive means and the fifth unidirectional means.

9. The circuit arrangement according to claim 8, wherein said control circuit comprises means for rendering the switching element (S) conductive and non-conductive dependent upon the voltage across said first capacitive means.

10. The circuit arrangement according to claim 7, which further a fifth circuit comprising fourth-capacitive means for connecting the common terminal (N2) to a terminal (N4) between the first capacitive means and the fifth unidirectional means.

11. The circuit arrangement according to claim 10, which further comprises a series arrangement comprising the antiboost switching element (S) and the primary winding, said series arrangement connecting terminal (N1) to a terminal (N4) between the first capacitive means and the fifth unidirectional means.

12. The circuit arrangement according to claim 10, wherein the fifth circuit comprises a series arrangement of the fourth capacitive means and the first capacitive means.

13. The circuit arrangement according to claim 12 which further comprises a series arrangement comprising the antiboost switching element (S) and the primary winding, said series arrangement connecting terminal (N1) to a terminal (N4) between the first capacitive means and the fifth unidirectional means.

14. The circuit arrangement according to claim 5, which further comprises a series arrangement comprising the anti-boost switching element(s) and the primary winding, said series arrangement connecting terminal (N1) to a terminal (N4) between the first capacitive means and the fifth unidirectional means.

15. The circuit arrangement according to claim 14, wherein said control circuit comprises means for rendering the switching element (S) conductive and non-conductive dependent upon the voltage across said first capacitive means.

16. Circuit arrangement according to claim 1 wherein the power feedback means comprises fifth capacitive means.

17. The circuit arrangement according to claim 1, wherein said control circuit comprises means for rendering the switching element conductive and non-conductive dependent upon the voltage across said first capacitive means.

* * * * *